US005730087A

United States Patent [19]

Phelps

[11] Patent Number: 5,730,087

[45] Date of Patent: Mar. 24, 1998

[54] TUBE ENCLOSURE AND FLOOR SUPPORT ROUTING FOR ONCE THROUGH STEAM GENERATORS

[75] Inventor: Calvin E. Phelps, Akron, Ohio

[73] Assignee: The Babcock & Wilcox Company, New Orleans, La.

[21] Appl. No.: 434,625

[22] Filed: May 4, 1995

[51] Int. Cl.[6] ..... F22B 37/00

[52] U.S. Cl. ..... 122/6 A; 122/235.12; 122/235.11; 122/235.22; 122/235.23; 122/510

[58] Field of Search ..... 122/6 A, 235.11, 122/235.12, 235.13, 235.19, 235.22, 235.23, 235.24, 235.25, 510, 235.15

[56] References Cited

U.S. PATENT DOCUMENTS

| | | | |
|---|---|---|---|
| 2,723,650 | 11/1955 | Beute et al. | 122/235.11 |
| 3,457,903 | 7/1969 | Huge | 122/235.11 |
| 4,191,133 | 3/1980 | Stevens | 122/6 A |
| 4,198,930 | 4/1980 | Pratt et al. | 122/6 A |
| 4,245,588 | 1/1981 | Gill et al. | 122/6 A |
| 4,982,703 | 1/1991 | Albrecht | 122/6 A |
| 5,201,282 | 4/1993 | Albrecht | 122/235.23 |

*Primary Examiner*—Henry A. Bennett
*Assistant Examiner*—Jiping Lu
*Attorney, Agent, or Firm*—Daniel S. Kalka; Robert J. Edwards

[57] ABSTRACT

Pendant convection pass tube circuitry of once through steam generator have their floor and floor support tubes enlarged by a swage coupling and connected to enlarged sidewall tubes supported from steel boiler top supports to provide a more flexible circuitry operating at decreased temperatures and pressure losses.

3 Claims, 1 Drawing Sheet

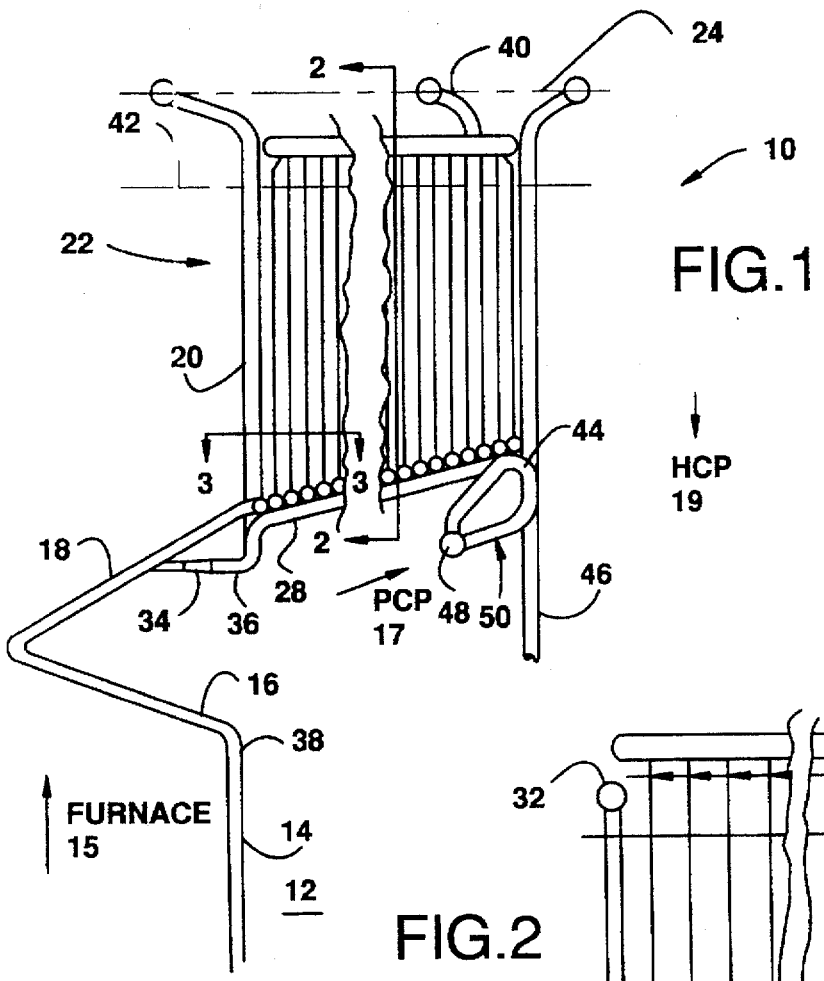
FIG.1
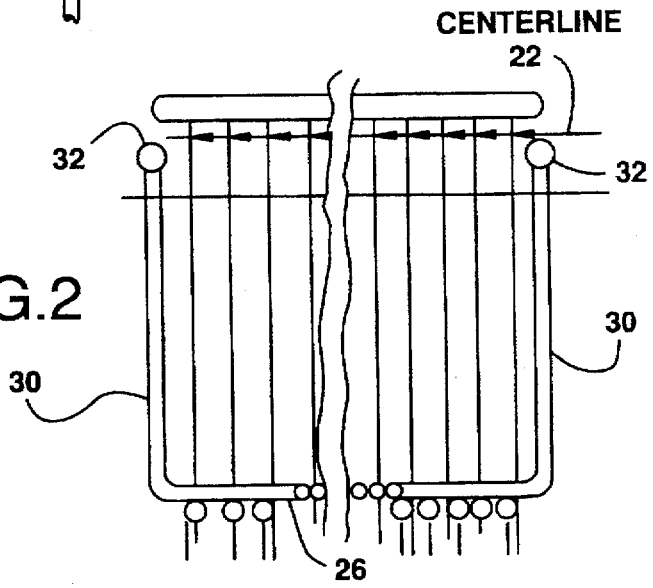
FIG.2
FIG.3
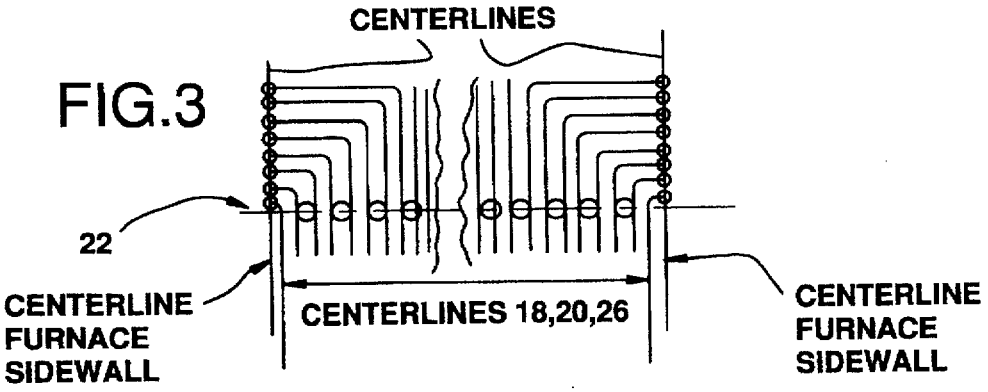

TUBE ENCLOSURE AND FLOOR SUPPORT ROUTING FOR ONCE THROUGH STEAM GENERATORS

BACKGROUND OF THE INVENTION

1. Field of the Invention

The present invention generally relates to once through steam generators and more particularly to steam tube enclosures and supports for same.

2. Description of the Related Art

It is known that modern once through steam generators are designed for starting up and shutting down more rapidly than prior art generators. Also they are designed for daily on-off cycling operation and for extended life. Therefore, they must be designed with greater pressure part thermal expansion and contraction flexibilities.

One problem area on steam generators with horizontal heating surfaces arranged inside tube enclosure walls with one or more vertical down gas passes (horizontal convection pass HCP) is the tube enclosure boundary containing pendant heating surfaces (the pendant convection pass PCP), that connects the HCP to the boiler furnace being arranged in a vertical up gas pass. FIG. 1 typically shows this type of furnace convection pass arrangement. The boiler tube enclosure fluid circuitries are normally arranged so that the welded junctions of the furnace, PCP, and HCP generally flow out of phase with respect to fluid thermal gradient changes.

Some manufacturer(s) of these type boiler arrangements design for quick and frequent thermal cycles by circulating the PCP sidewalls in more than one fluid pass without much lag time between each pass. This is done to temper the impact of thermal gradient changes and resulting expansion or contraction forces, especially experienced during boiler operational trips and hot restarts.

A further complication for flexibility of designs with these type units is that the PCP floor is generally arranged with small diameter tubing that must be mechanically supported by external support steel and attachments. Since the fluid thermal gradients will quickly pass through the unit during trips or hot restarts, the mechanical PCP floor supports and pressure part attachments can cause added flexibility problems since they will operate at a different thermal level cycle than the pressure part to which they are attached.

The PCP roof circuit is generally not membraned nor constructed of fully welded tube and web enclosure therefore, the roof structure inherently provides sufficient flexibility for the PCP.

Thus it is seen that a more flexible pendent convection pass circuit, especially its floor support and floor tubing was needed which would not require mechanical floor supports.

SUMMARY OF THE INVENTION

The present invention solves the mentioned problems associated with pendant convection pass PCP floors and floor supports as well as others by providing a tube construction and routing which eliminates the need for floor supports.

This is accomplished by having the PCP floor tubes split equally and being pack bent to form PCP sidewalls that are supported from the top boiler structural supports. The diameter of the PCP floor and floor support tubes and the front screen tubes are enlarged and swage connected to the smaller diameter furnace rear wall supports.

In view of the foregoing it will be seen that one aspect of the present invention is to provide a floor support constructed of tubing from the same circuit with the same thermal cycles to improve flexibility of the tubing.

Another aspect of the present invention is to provide PCP sidewalls constructed from the PCP floor tubes through pack bends at the sides to improve flexibility of the walls and floor because of their close coupled series flow circuitry arrangement and elimination of weld jointed separate circuits.

Yet another aspect of the present invention is to provide a PCP floor seal designed for flexibility consideration by offsetting it away from the load carrying rear screen tubes.

Still yet another aspect of the present invention is to provide an upper furnace arranged with non-split flow circuitry so that the furnace fluid flow pressure drop will be less and temperature of the upper furnace materials will be less since steam separation and superheating of the steam will not be present.

These and other aspects of the present invention will be more fully understood after a review of the following description of the preferred embodiment when considered with the accompanying drawings.

BRIEF DESCRIPTION OF THE DRAWINGS

FIG. 1 is a steam tubing schematic for a once through generator with a steam tube routing of the present invention.

FIG. 2 is a cross-section taken along A—A of the FIG. 1. schematic.

FIG. 3 is a cross-section taken along section $A_1$—$A_1$ of the FIG. 1. schematic.

DESCRIPTION OF THE PREFERRED EMBODIMENT

Referring now to the drawings generally and FIG. 1 particularly, the arrangement will be seen for the boiler tube enclosure circuitries for the welded junctions of the furnace 15, PCP 17, and HCP 19.

The boiler 10 has rear wall 12 tubing 14 that extends up through a first pack bend to form the lower arch 16 and a second pack bend to form the upper arch 18. The upper portion of the arch 18 is shielded from boiler 10 radiation that allows tubes 20 to be rerouted out of the arch 18 to form a front screen tube assembly 22 which supports the boiler rear wall 12 by transferring the lead of same to top boiler 10 steel support assembly 24. This assembly also supports the PCP floor support tubes 28 that are rerouted out of the arch 18, and the PCP floor tubes 26, best seen in FIG. 2. The PCP floor tubes are equally split routed to each side of the boiler 10 and then pack bent to form the PCP sidewalls 30 that provide flow to outlet headers 32.

As may be best seen in FIG. 1, the diameters of the floor support tubes 28 and front screen tubes 20 are enlarged at their connection to the smaller diameter furnace rear wall tubes by a swage coupling 34 to provide enhanced load carrying capabilities by these tubes in their ultimate connection to the top support 24. The front screen tubes 20 normally require spring supports to transfer their load to the support 24. However, a solid rod type of support to the steel support 24 may be used, and the mentioned spring supports are used however at location 36 and 38 to transfer furnace rear wall tube 14 loads to the front screen tubes 20.

If water cooled furnace rear wall support is desired, as an alternate, the front screen tubes 22 may be routed down to weld into the rear wall before routing up into the gas pass to their outlet header.

The PCP floor support tubes are routed into the PCP gas pass to form the rear screen tubes (40) to share support of the PCP floor with the front screen tubes 20, by transferring loads to the top boiler support steel 24. The roof tubes 42, shown by a centerline, are similar to prior art.

To provide increased pressure part flexibility and to allow space to construct a welded seal 44, the PCP floor tubes 26 extend past the rear screen tubes 40. The HCP front wall enclosure tubes 46 are routed out of the setting to a transitional header 48 to construct an additional row of rear screen tubes 50 to support the HCP front wall 46 by transferring loads to the top boiler support steel 24.

Certain modifications and improvements have been deleted herein for the sake of conciseness and readability but are fully intended to be within the scope of the following claims.

I claim:

1. In a universal pressure boiler having a furnace with front, rear, and side walls, an improved pendant convection pass, comprising a pendant convection pass tube circuit having pendant convection pass floor tubes connected on a one-to-one basis with furnace rear wall tubes, said furnace rear wall tubes having a smaller diameter than said pendant convection pass floor tubes and each tube being connected with a swage coupling;

said pendant convection pass floor tubes being equally split, routed to each side of the boiler and then pack bent to form a series of pendant convection pass sidewall tubes connected in series flow to said pendant convection pass floor tubes; and a top boiler support connected to said pendant convection pass sidewall tubes and pendant convection pass floor tubes to support the pendant convection pass tube circuit.

2. An improved convection pass as set forth in claim 1 wherein said furnace rear wall tubes include a continuous tube having a first arch bend in one direction and a second arch bend in a second direction opposite said one direction.

3. An improved convection pass as set forth in claim 2 wherein said swage coupling connects each of said pendant convection pass floor tubes to each of said furnace rear wall tubes at the second arch bend of said furnace rear wall tube.

* * * * *